US011045372B2

(12) United States Patent
Hsieh et al.

(10) Patent No.: US 11,045,372 B2
(45) **Date of Patent: *Jun. 29, 2021**

(54) ANTI-BEDSORE BED

(71) Applicants: TERA AUTOTECH CORPORATION, Taichung (TW); Department of Electrical Engineering, National Changhua University of Education, Changhua (TW)

(72) Inventors: Meng-Yuan Hsieh, Changhua (TW); Tsair-Rong Chen, Changhua (TW); Yi-Lung Lee, Taichung (TW); Yu-Lin Juan, Changhua (TW)

( * ) Notice: Subject to any disclaimer, the term of this patent is extended or adjusted under 35 U.S.C. 154(b) by 169 days.

This patent is subject to a terminal disclaimer.

(21) Appl. No.: 16/123,991

(22) Filed: Sep. 6, 2018

(65) Prior Publication Data

US 2020/0078240 A1 Mar. 12, 2020

(51) Int. Cl.
*A61G 7/057* (2006.01)

(52) U.S. Cl.
CPC ..... *A61G 7/0573* (2013.01); *A61G 7/05707* (2013.01); *A61G 7/05769* (2013.01); *A61G 2200/327* (2013.01); *A61H 2201/0142* (2013.01); *A61H 2203/0456* (2013.01)

(58) Field of Classification Search
CPC .. A61G 7/057; A61G 7/05753; A61G 7/0573; A61G 7/05707; A61G 7/05769; A61G 7/05715; A61G 7/05723; A61G 2200/327; A61H 2201/0142; A61H 2203/0456
See application file for complete search history.

(56) References Cited

U.S. PATENT DOCUMENTS 3,298,363 A * 1/1967 Parkin ..... 601/103
3,999,234 A * 12/1976 Regan ..... A47C 23/002 5/716
5,235,710 A * 8/1993 Nagashima ..... A47C 23/065 4/547
5,237,501 A * 8/1993 Gusakov ..... A61G 7/0573 600/587
5,446,933 A * 9/1995 Gabelhouse ..... A47C 23/002 5/670
5,699,566 A * 12/1997 Chuang ..... A61G 7/015 5/613

(Continued)

*Primary Examiner* — Peter M. Cuomo
*Assistant Examiner* — Rahib T Zaman
(74) *Attorney, Agent, or Firm* — Che-Yang Chen; Law Office of Michael Chen

(57) ABSTRACT

An anti-bedsore bed may comprise a bed unit, a first bed body, and a second bed body. The bed unit has a first mattress, and a bottom portion is coupled on a bottom surface thereof. Moreover, the bottom portion comprises a plurality of first supporting units at positions corresponding to a user's upper back, middle portion of back and lower back, and each of the first supporting units has a first sliding block moveably mounted on the bottom portion. Each of the first sliding blocks has a first supporting rod, and an abutting unit is pivotally connected to an upper end of the first supporting rod. Each of first power units secured on a bottom surface of the first sliding block is engaged with the first supporting rod while each of second power units secured on the bottom portion is engaged with the first sliding block.

10 Claims, 15 Drawing Sheets

(56) References Cited

U.S. PATENT DOCUMENTS

| | | | | |
|---|---|---|---|---|
| 7,520,011 | B1 * | 4/2009 | Liberkowski | A47C 23/002 5/731 |
| 9,724,257 | B1 * | 8/2017 | Chen | A61G 7/0573 |
| 9,775,765 | B2 * | 10/2017 | Grigoreva | A61H 1/02 |
| 10,660,808 | B2 * | 5/2020 | Hashimoto | A61G 7/015 |
| 2004/0064896 | A1 * | 4/2004 | Partian | A61G 7/057 5/713 |
| 2018/0369040 | A1 * | 12/2018 | Sheth | A61H 9/0071 |

* cited by examiner

ANTI-BEDSORE BED

FIELD OF THE INVENTION

The present invention relates to a medical bed and more particularly to an anti-bedsore bed.

BACKGROUND OF THE INVENTION

Bedsores also called pressure sores or pressure ulcers are injuries to skin and underlying tissue resulting from prolonged pressure on the skin. Bedsores generally happen to a patient who has limitations on moving their body such as paralysis patient, and the skin and underlying tissue are pressured and have ulcers due to poor blood circulation. Thus, turning and re-positioning the patient in the bed to keep the skin free from exposure to urine and stool become very important. For taking care of this kind of patient, a nurse or caregiver needs to turn or re-position the patient in every 1 to 2 hours.

However, frequently re-positioning the patient puts a huge strain to the nurse or caregiver, and when the bed needs to be cleaned or disinfected, it may need more labors. Therefore, there remains a need for a new and improved design for an anti-bedsore bed to overcome the problems presented above.

SUMMARY OF THE INVENTION

The present invention provides an anti-bedsore bed which comprises a bed unit, a first bed body, and a second bed body. The bed unit has a first mattress, and a bottom portion is coupled on a bottom surface thereof. Moreover, the bottom portion comprises six first supporting units evenly arranged into three sets at positions corresponding to a user's upper back, middle portion of back and lower back, and each of the first supporting units has a first sliding block moveably mounted on the bottom portion. Furthermore, each of the first sliding blocks has a first supporting rod, and an abutting unit is pivotally connected to an upper end of the first supporting rod. Each of first power units secured on a bottom surface of the first sliding block is engaged with the first supporting rod while each of second power units secured on the bottom portion is engaged with the first sliding block such that the first supporting rod is configured to be driven by the first power unit to move upwardly or downwardly, and the second power unit is adapted to drive the two adjacent first sliding block to move in lateral directions. Moreover, the positions of the first supporting units are adjustable according to a position of the back portion of a user. In addition, the bottom portion comprises a second supporting unit and a third supporting unit respectively located at positions corresponding to a user's knee and head, and the second supporting unit has two second sliding blocks moveably mounted on the bottom portion while the third supporting unit comprises two third sliding blocks connected to a lower portion of the bottom portion. Also, each of the second sliding blocks has a second supporting rod while each of the third sliding blocks comprises a third supporting rod, and a top portion of the two second supporting rods is pivotally connected to a foot rest while a top portion of the two third supporting rods is pivotally connected to a head rest. The first power units secured on a bottom surface of the second sliding blocks are respectively connected to the second supporting rods while the first power units secured on a bottom surface of the third sliding blocks are respectively connected to the third supporting rods. Also, the second power units secured on the bottom portion are respectively connected to the second sliding blocks and the third sliding blocks. Thus, the second supporting rods and the third supporting rods are configured to be driven by the first power units to move upwardly or downwardly, and the two second sliding blocks or the two third sliding blocks are adapted to be driven by the second power units to move in lateral directions synchronously. Additionally, the supporting angles and directions of the second sliding blocks and the third sliding blocks are adjustable according to a lying position of a user. The first mattress comprises a plurality of through holes located at positions corresponding to the first supporting units, the second supporting unit and the third supporting unit such that the abutting units, the foot rest, the head rest are respectively accommodated in the through holes before the first supporting rods, the second supporting rods, and the third supporting rods are moved upwardly or respectively protrude out of the through holes when the first supporting rods, the second supporting rods, and the third supporting rods are lifted. The first bed body and the second bed body are coupled side by side for use, and the first bed body has a bed stead which is configured to support the bottom portion of the bed unit. The second bed body comprises a first frame, a second frame and a third frame, which are pivotally connected in sequence. A second bed mattress is positioned on an upper surface of the first frame, the second frame and the third frame, and a plurality of sliding wheels are installed at a lower portion of the second frame to enable the second bed body to be movable. Moreover, each of the first frame and the third frame has at least two bed legs pivotally connected at a lower portion thereof, and the bed legs are configured to perform between an unfolded position standing on the floor and a folded position received in the first frame or the third frame. Additionally, the third frame and the first frame are configured to be respectively folded up and down relative to the second frame, and after securing pivots between the first frame and the second frame and between the second frame and the third frame, the second bed body is configured to be used as a wheelchair.

Comparing with conventional hospital bed, the present invention is advantageous because: (i) the supporting rods are configured to move upwardly in a preset time interval, and the abutting units are adapted to uplift a user's body to detach from the first mattress for a designed time, thereby achieving the anti-bedsore effect; (ii) the second bed body not only can be used for the caregiver, but also for a patient when the bed unit and the first bed body need to be cleaned and disinfected or as a wheelchair when the patient needs to go out, which saves labors and time; (iii) when a patient lies the bed unit on his/her back, the head rest and the foot rest are configured to respectively be uplifted by the third supporting rods and the second supporting rods so as to drive the patient's head and knees up properly, and the patient is easily turned by a caregiver, thereby completing actions such as cleaning body, changing clothes, changing lying positions; and (iv) when the third supporting rods are completely retracted or retracted enormously and the headboard of the first bed body is pulled in a lateral direction, a space formed above the head rest is adapted to accommodate a water collector which enables the patient to directly have hair washing without leaving the first bed body.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 13:
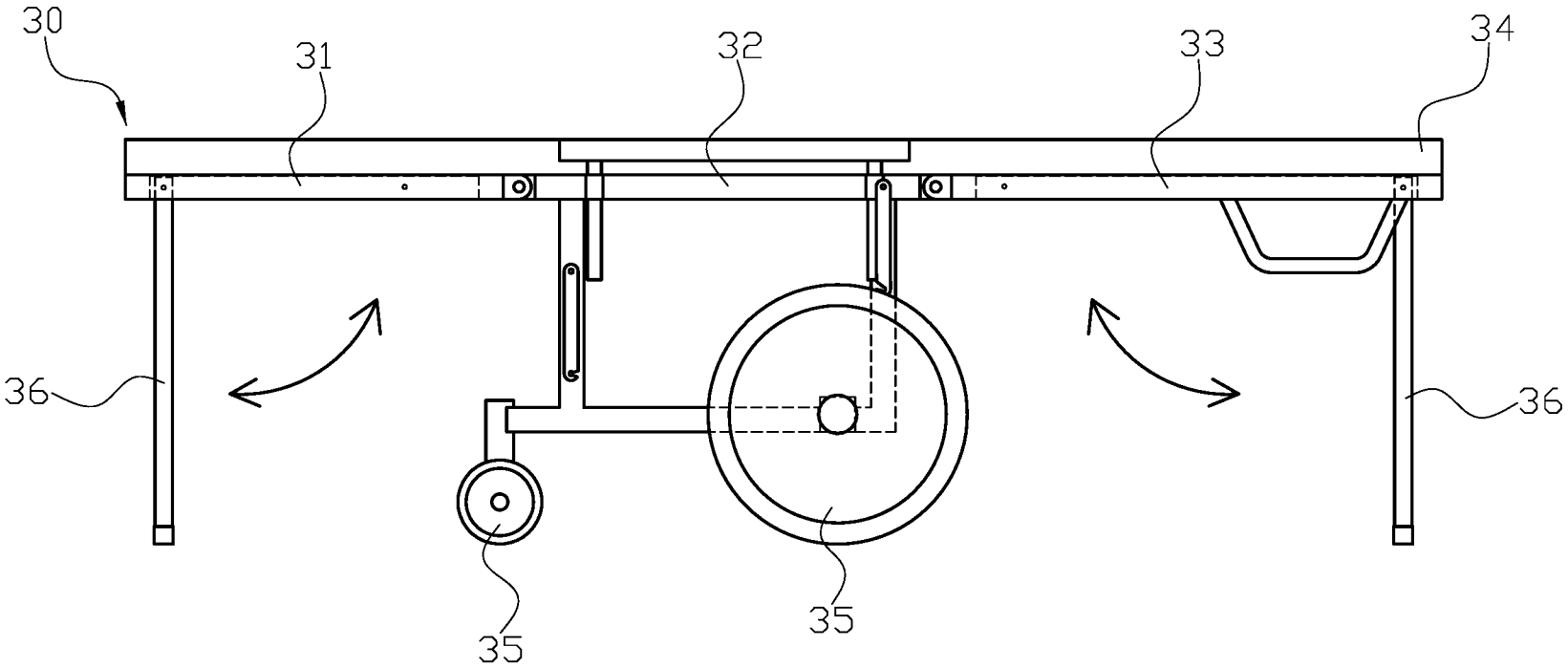
FIG. 13 is a schematic view illustrating bed legs of the anti-bedsore bed are folded in the present invention.
Figure 14:
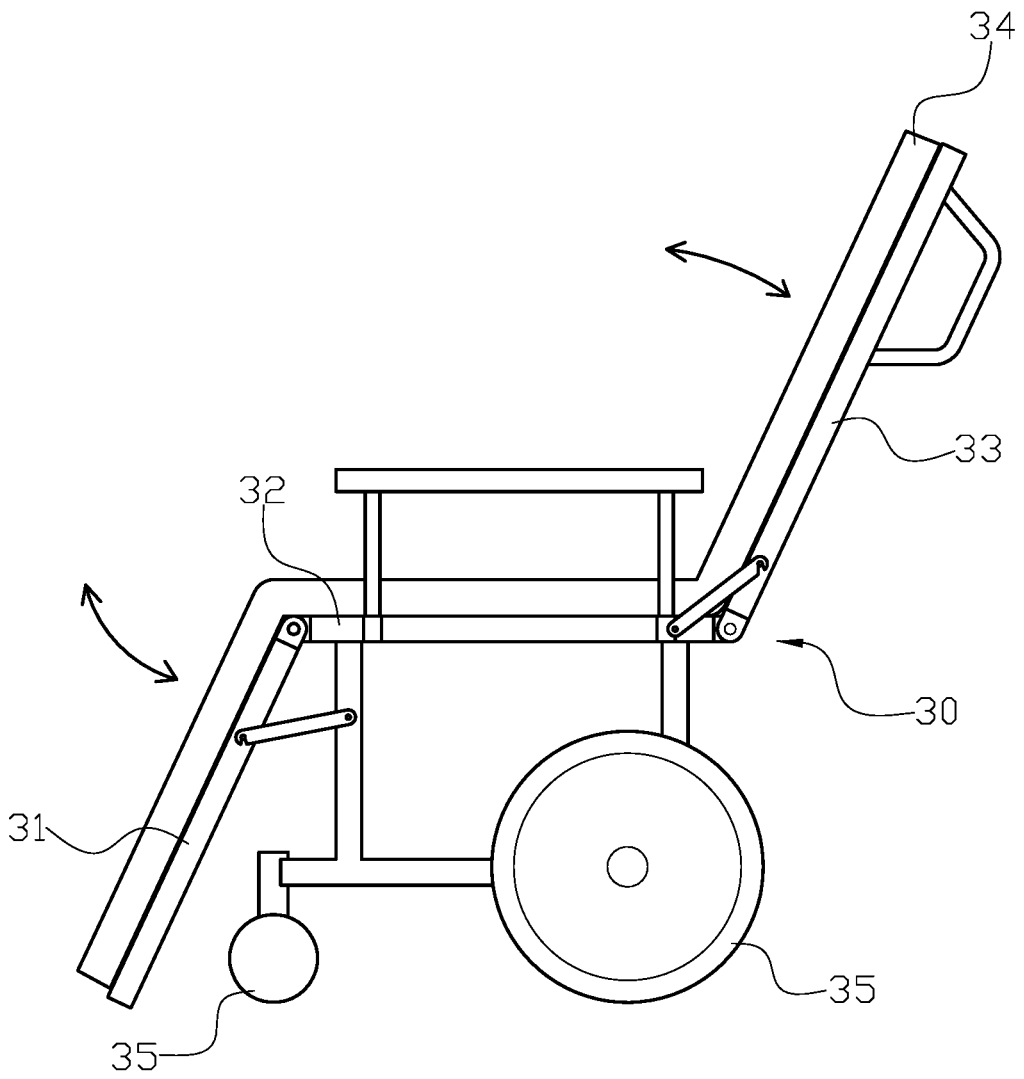
FIG. 14 is a plane view illustrating the second bed body of the anti-bedsore bed is used as a wheelchair.
Figure 15:
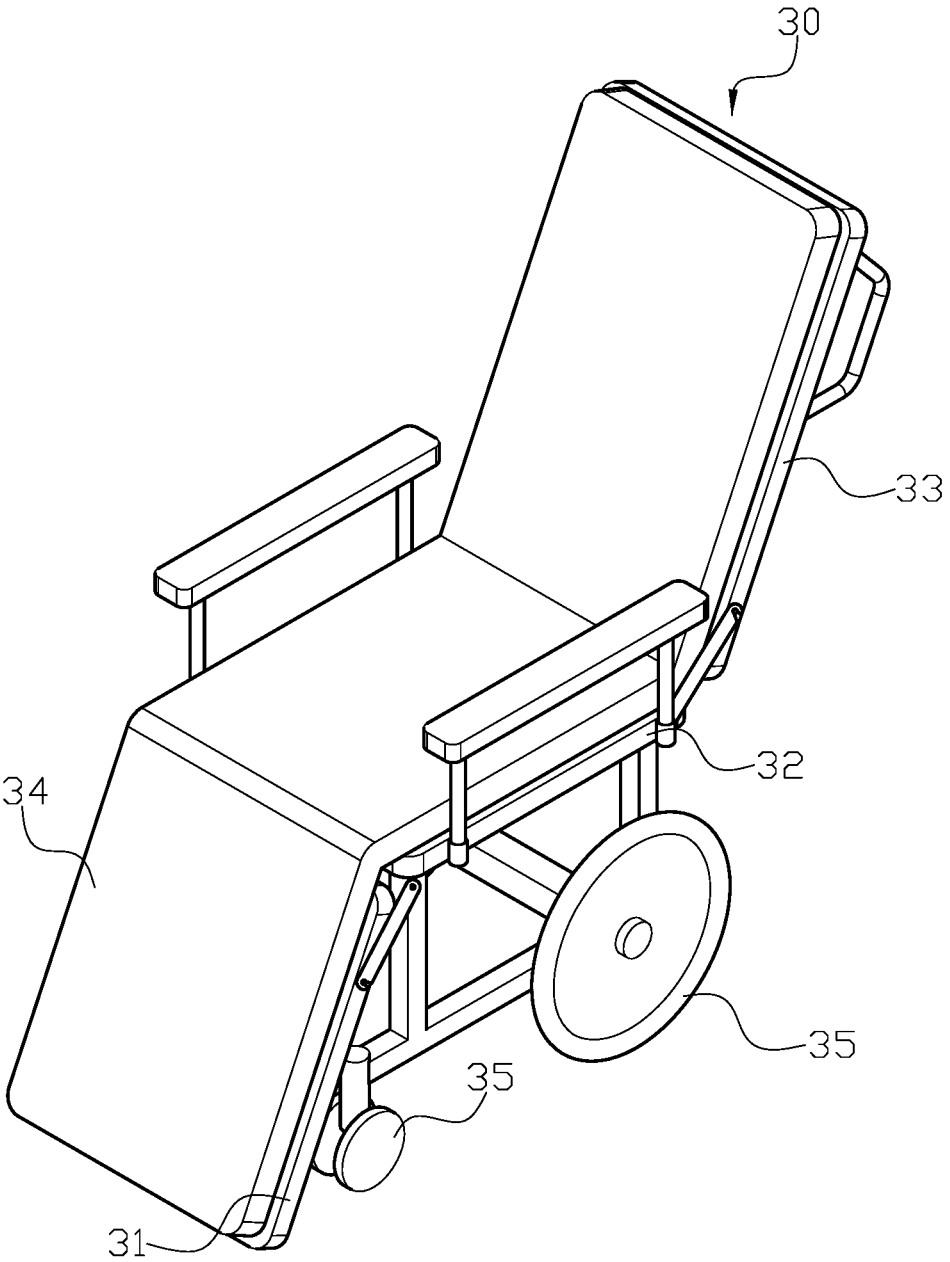
FIG. 15 is a three-dimensional view illustrating the second bed body of the anti-bedsore bed is used as a wheelchair.

In order to further understand the goal, characteristics and effect of the present invention, a number of embodiments along with the drawings are illustrated as following:

Referring to FIGS. 1 to 9, the present invention provides an anti-bedsore bed which comprises a bed unit (10), a first bed body (20), and a second bed body (30). The bed unit (10) has a first mattress (11), and a bottom portion (12) is coupled on a bottom surface thereof. Moreover, the bottom portion (12) comprises six first supporting units (13) evenly arranged into three sets at positions corresponding to a user's upper back, middle portion of back and lower back, and each of the first supporting units (13) has a first sliding block (131) moveably mounted on the bottom portion (12). Furthermore, each of the first sliding blocks (131) has a first supporting rod (132), and an abutting unit (133) is pivotally connected to an upper end of the first supporting rod (132). Each of first power units (16) secured on a bottom surface of the first sliding block (131) is engaged with the first supporting rod (132) while each of second power units (17) secured on the bottom portion (12) is engaged with the first sliding block (131) such that the first supporting rod (132) can be driven by the first power unit (16) to move upwardly or downwardly, and the second power unit (17) can drive the two adjacent first sliding blocks (131) to move in lateral directions. Moreover, the positions of the first supporting units (13) are adjustable according to a position of the back portion of a user. In addition, the bottom portion (12) comprises a second supporting unit (14) and a third supporting unit (15) respectively located at positions corresponding to a user's knee and head, and the second supporting unit (14) has two second sliding blocks (141) moveably mounted on the bottom portion (12) while the third supporting unit (15) comprises two third sliding blocks (151) connected to a lower portion of the bottom portion (12). Also, each of the second sliding blocks (141) has a second supporting rod (142) while each of the third sliding blocks (151) comprises a third supporting rod (152), and a top portion of the two second supporting rods (142) is pivotally connected to a foot rest (143) while a top portion of the two third supporting rods (152) is pivotally connected to a head rest (153). The first power units (16) secured on a bottom surface of the second sliding blocks (141) are respectively connected to the second supporting rods (142) while the first power units (16) secured on a bottom surface of the third sliding blocks (151) are respectively connected to the third supporting rods (152). Also, the second power units (17) secured on the bottom portion (12) are respectively connected to the second sliding blocks (141) and the third sliding blocks (151). Thus, the second supporting rods (142) and the third supporting rods (152) are configured to be driven by the first power units to move upwardly or downwardly, and the two second sliding blocks (141) or the two third sliding blocks (151) are adapted to be driven by the second power units (17) to move in lateral directions synchronously. Additionally, the supporting angles and directions of the second sliding blocks (141) and the third sliding blocks (151) are adjustable according to a lying position of a user. The first mattress (11) comprises a plurality of through holes (111) located at positions corresponding to the first supporting units (13), the second supporting unit (14) and the third supporting unit (15) such that the abutting units (133), the foot rest (143), the head rest (153) are respectively accommodated in the through holes (111) before the first supporting rods (132), the second supporting rods (142), and the third supporting rods (152) are moved upwardly or respectively protrude out of the through holes (111) when the first supporting rods (132), the second supporting rods (142), and the third supporting rods (152) are lifted. The first bed body (20) and the second bed body (30) are coupled side by side for use, and the first bed body (20) has a bed stead (21) which is configured to support the bottom portion (12) of the bed unit (10). The second bed body (30) comprises a first frame (31), a second frame (32) and a third frame (33), which are pivotally connected in sequence. A second bed mattress (34) is positioned on an upper surface of the first frame (31), the second frame (32) and the third frame (33), and a plurality of sliding wheels (35) are installed at a lower portion of the second frame (32) to enable the second bed body (30) to be movable. Moreover, each of the first frame (31) and the third frame (33) has at least two bed legs (36) pivotally connected at a lower portion thereof, and the bed legs (36) are configured to perform between an unfolded position standing on the floor and a folded position received in the first frame (31) or the third frame (33) (as shown in FIG. 13). Additionally, the third frame (33) and the first frame (31) are configured to be respectively folded up and down relative to the second frame (32) (as shown in FIG. 14), and after securing pivots between the first frame (31) and the second frame (32) and between the second frame (32) and the third frame (33), the second bed body (30) can be used as a wheelchair (as shown in FIG. 15).

In one embodiment, the first bed body (20) is a medical bed of hospital, and a user can directly install the bed unit (10) on the bed stead (21) of the first bed body (20) to achieve the anti-bedsore effect.

In another embodiment, the bottom portion (12) of the bed unit (10) comprises at least four bed boards pivotally coupled in sequence.

Figure 1:
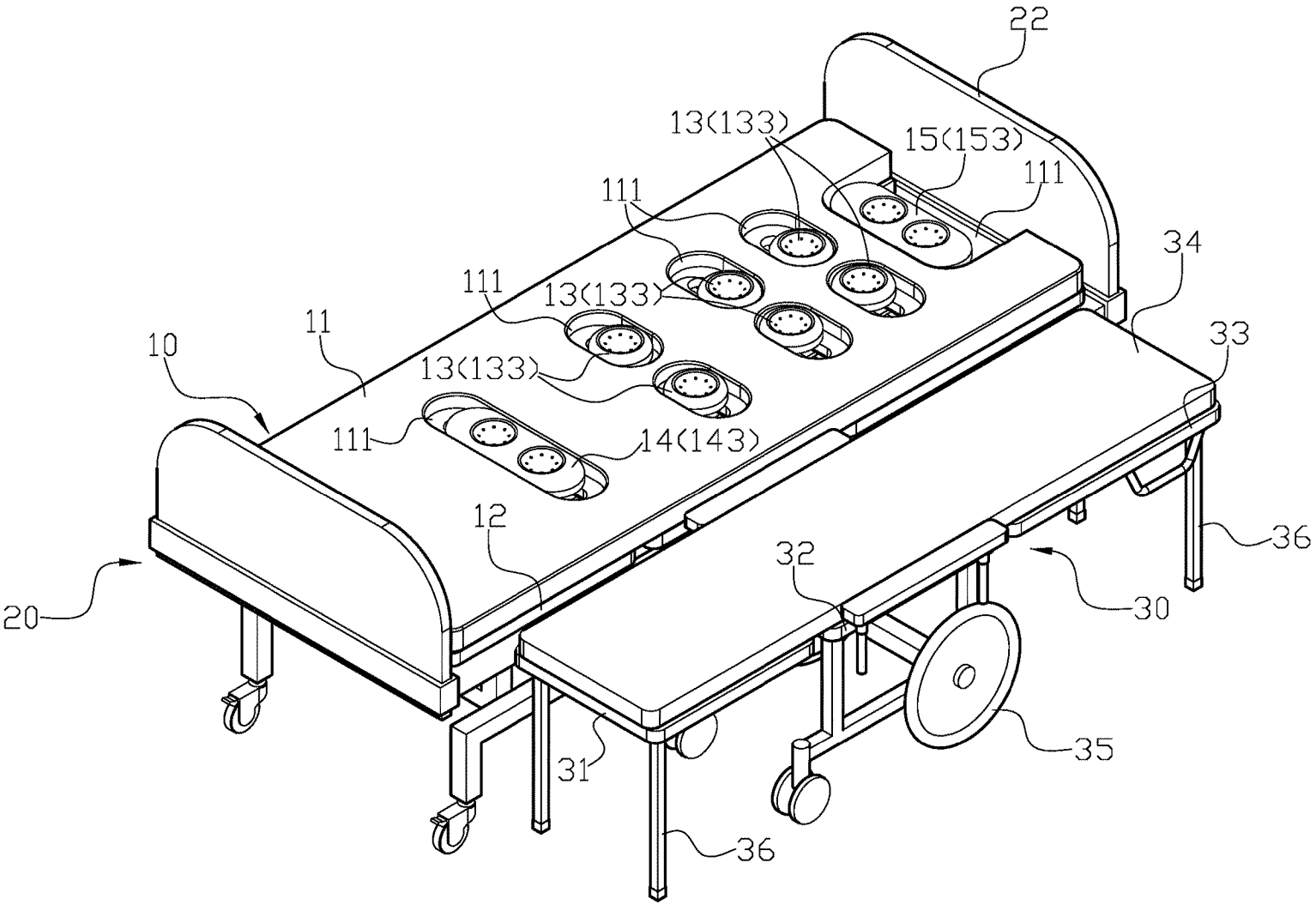
FIG. 1 is a three-dimensional assembly view illustrating a first bed body and a second bed body of an anti-bedsore bed are used in parallel in the present invention.
Figure 2:
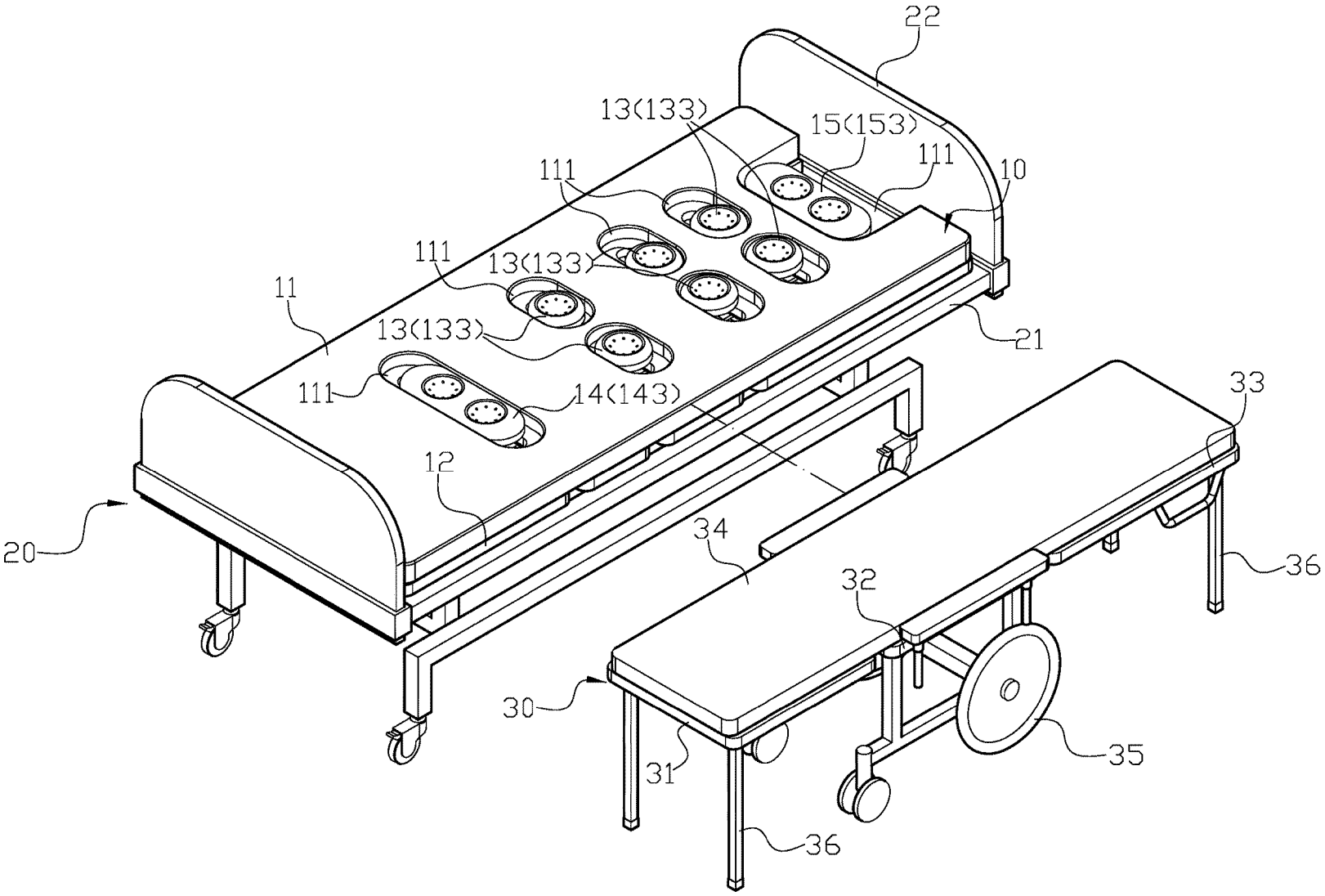
FIG. 2 is a three-dimensional exploded view of the anti-bedsore bed of the present invention.
Figure 3:
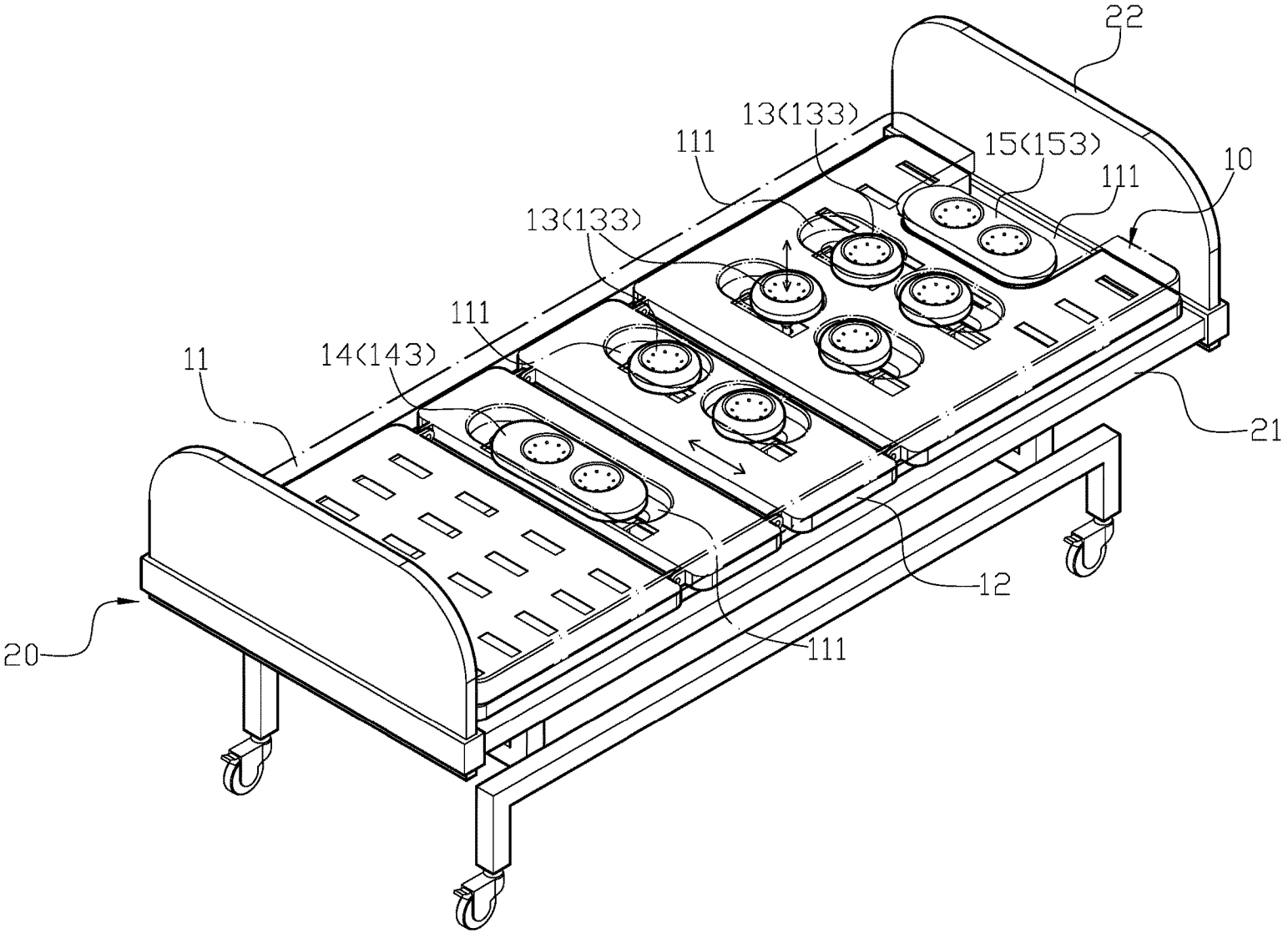
FIG. 3 is a three-dimensional view of a bed unit with the first bed body of the anti-bedsore bed of the present invention.
Figure 4:
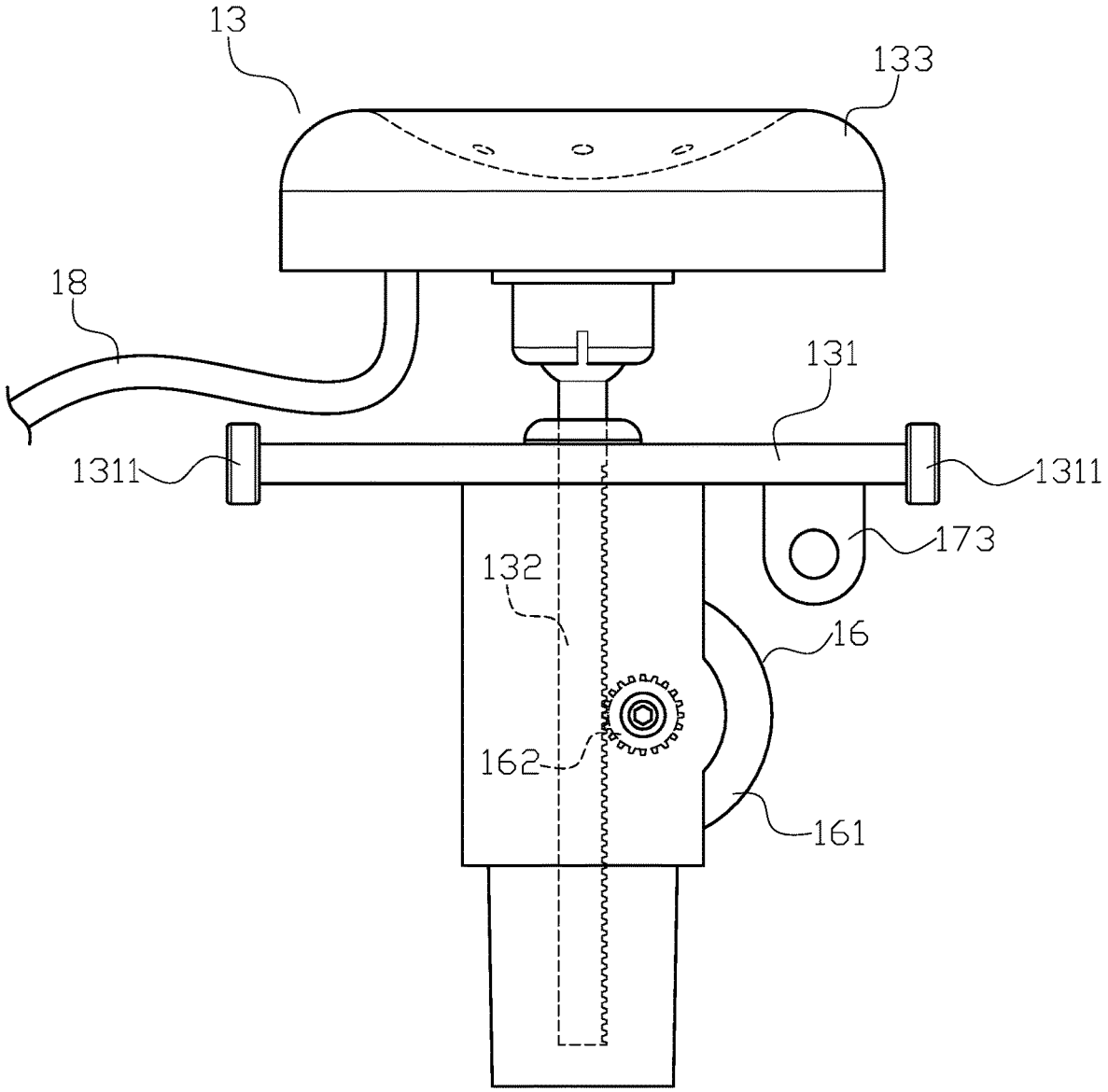
FIG. 4 is a plane view of a first supporting units of the anti-bedsore bed of the present invention.
Figure 5:
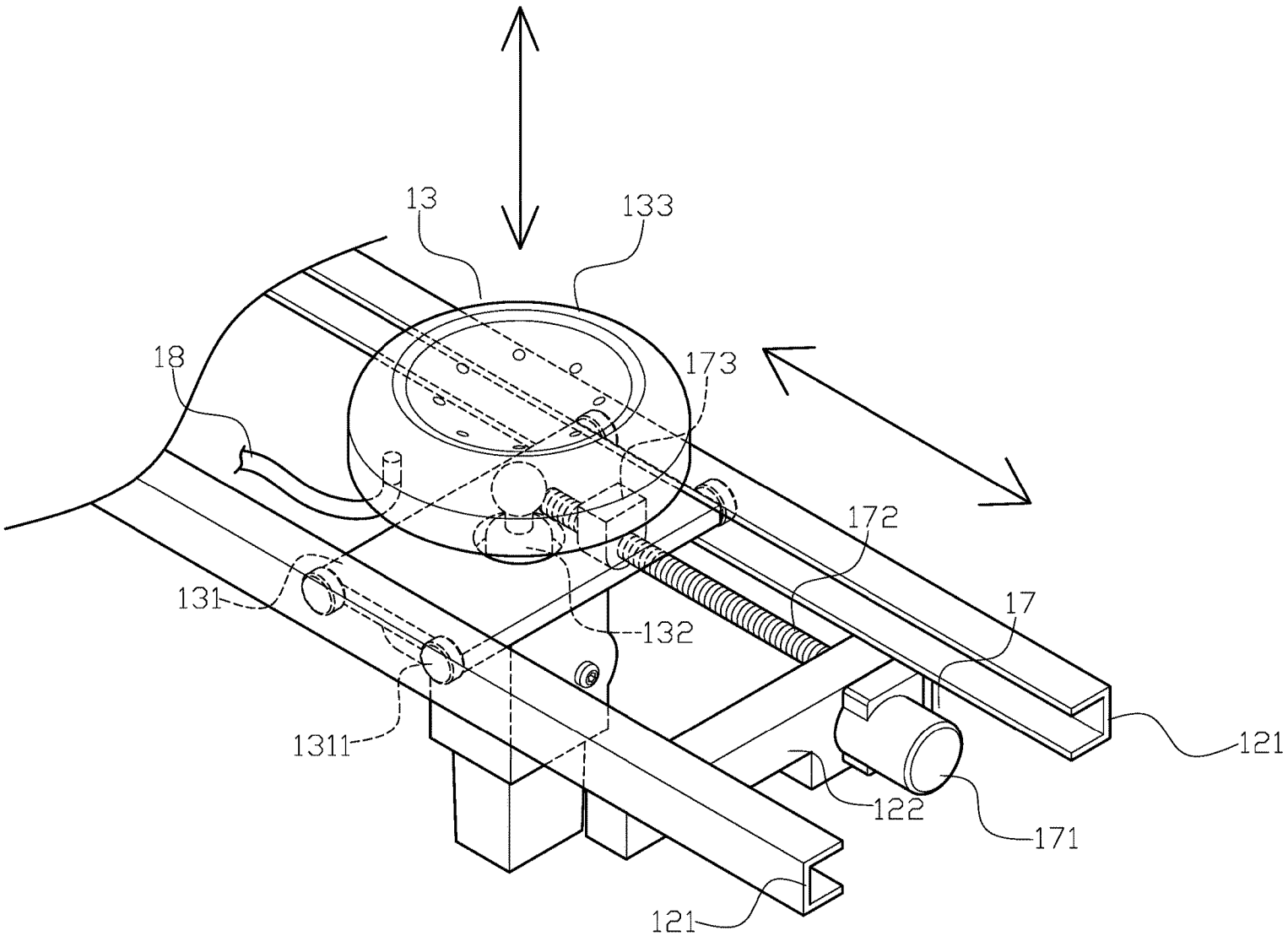
FIG. 5 is a three-dimensional view of the first supporting units of the anti-bedsore bed of the present invention.

In still another embodiment, the bottom portion (12) comprises a plurality of first openings located at positions corresponding to the first supporting units (13) and the second supporting unit (14), and each of the first openings has two sliding grooves (121) formed on an inner surface thereof; the sliding grooves (121) are configured to couple with two first wheel bodies (1311) of the first sliding block (131) and two second wheel bodies (1411) of the second sliding block (141); the second power units (17) respectively connected to the first supporting units (13) and the second supporting unit (14) are adapted to be secured on a supporting bar (122) which is located between the two adjacent sliding grooves (121) (as shown in FIGS. 4 and 5).

In a further embodiment, the bottom portion (12) has a second opening located at a position corresponding to the third supporting unit (15), and a lower portion of the second opening is connected and secured by a connecting member (123) which extends toward two lateral sides of the second opening; the connecting member (123) comprises two sliding grooves (121) which are configured to couple with third wheel bodies (1511) formed at two sides of the third supporting unit (15), and the second power unit (17) connected to the third supporting unit (15) is secured on a supporting bar (122) which is located between the two adjacent sliding grooves (121).

In still a further embodiment, each of the first power units (16) is a first motor (161) having a gear wheel (162) rotatably mounted on a spindle thereof, and the gear wheel (162) is configured to be engaged with the first supporting rods (132), the second supporting rods (142), and the third supporting rods (152) which are formed in gear racks such that the first motor (161) is adapted to drive the first supporting rods (132), the second supporting rods (142), and the third supporting rods (152) to move upwardly or downwardly (as shown in FIGS. 4 and 5); the first motor (161) has a function of vibration to massage a user through the abutting unit (133), the foot rest (143), and head rest (153) when the first supporting rods (132), the second supporting rods (142), and the third supporting rods (152) are moved.

In yet a further embodiment, each of the second power units (17) comprises a second motor (171) and a screw rod (172) collaborated with each other, and each of screw nuts (173) respectively secured on the bottom surfaces of the first sliding blocks (131), the second sliding blocks (141), and the third sliding blocks (151) is moveably engaged with the screw rod (172) such that the second motor (17) is adapted to drive the first sliding blocks (131), the second sliding blocks (141), and the third sliding blocks (151) to have movement in lateral directions (as shown in FIGS. 4 and 5).

In a particular embodiment, each of the abutting unit (133), the foot rest (143), and the head rest (153) is a cushion having a concaved top surface.

In another particular embodiment, each of the abutting unit (133), the foot rest (143), and the head rest (153) is an air bag which is configured to be inflated and deflated.

In a preferred embodiment, each of the abutting unit (133), the foot rest (143), and the head rest (153) is connected to an air pump through a hose (18) such that hot air or cold air is provided through the hose (18) to the abutting unit (133), the foot rest (143), or the head rest (153), thereby enabling the bed unit (10) to be used in different weathers (as shown in FIGS. 4 and 5).

In an advantageous embodiment, the first supporting units (13), the second supporting unit (14), and the third supporting unit (15) are electrically connected to a control unit which is provided to control the first supporting units (13), the second supporting unit (14), and the third supporting unit (15) to perform different actuation patterns and control the time intervals of the actuations of the first supporting units (13), the second supporting unit (14), and the third supporting unit (15).

Figure 6:
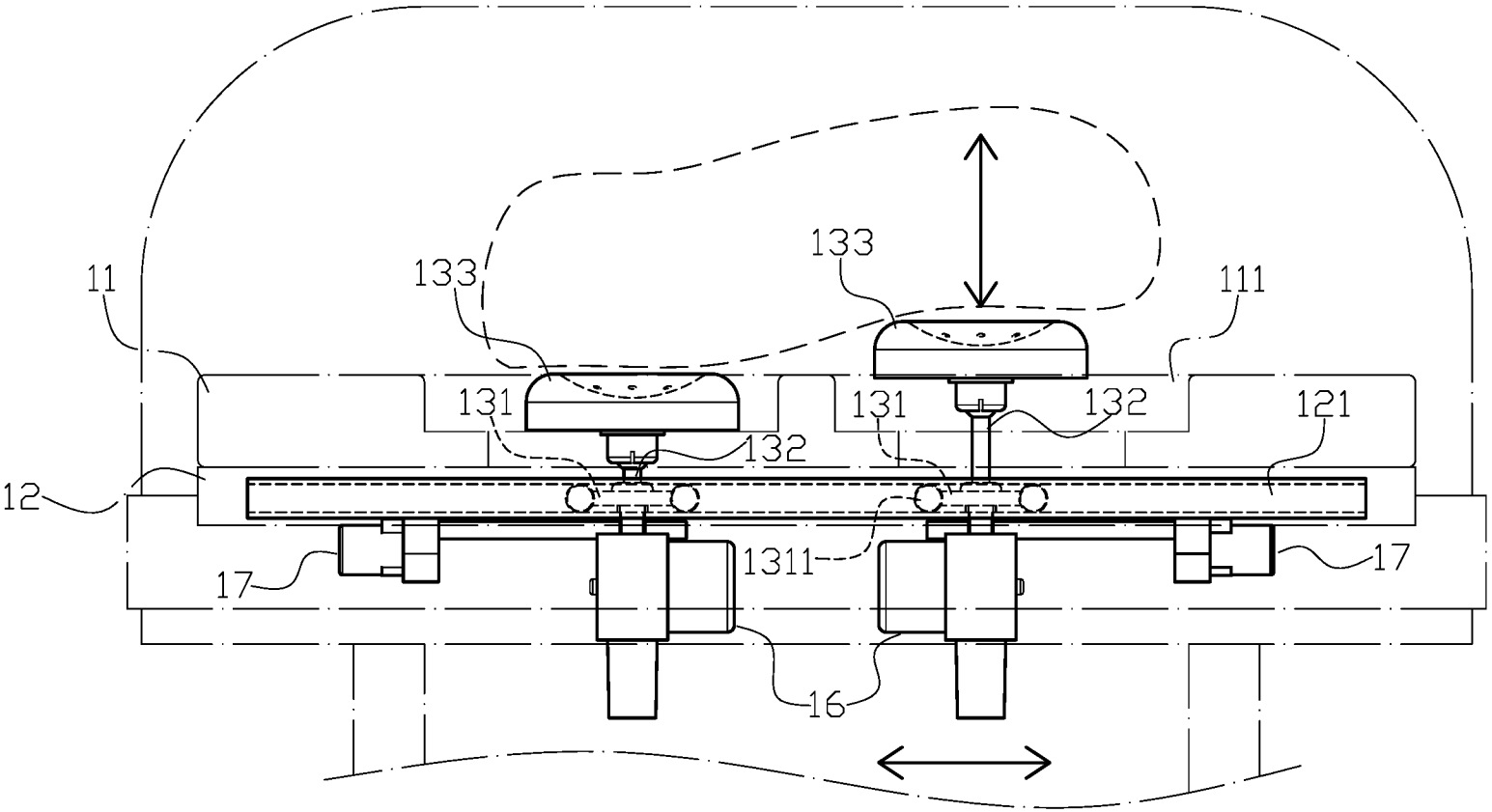
FIG. 6 is a schematic view illustrating a plurality of first supporting rods of the first supporting units of the anti-bedsore bed are lifted in the present invention.

In actual application, the supporting rods (132) are configured to move upwardly in a preset time interval, and the abutting units (133) are adapted to uplift a user's body to detach from the first mattress (11) for a designed time (as shown in FIG. 6), thereby achieving the anti-bedsore effect. As a result, with the anti-bedsore bed of the present invention, a nurse or a caregiver can save more time and energy to turn the patient. Furthermore, the second bed body (30) not only can be used for the caregiver, but also for a patient when the bed unit (10) and the first bed body (20) need to be cleaned and disinfected or as a wheelchair when the patient needs to go out, which saves labors and time.

Figure 7:
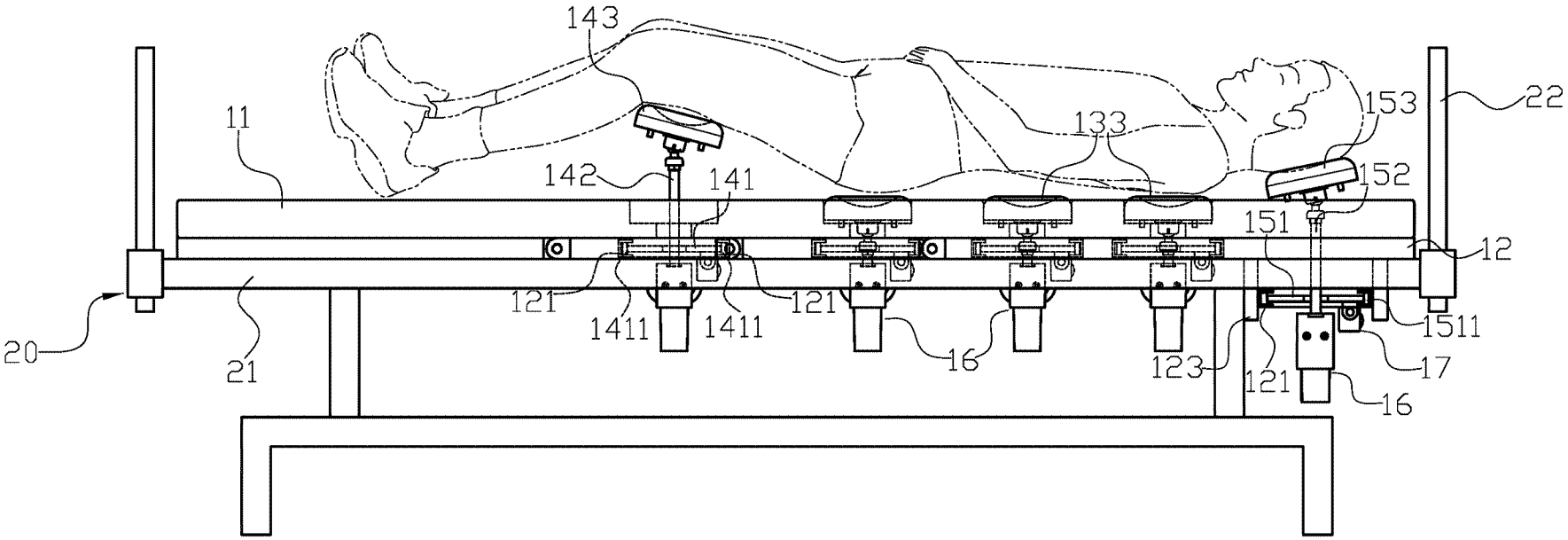
FIG. 7 is a schematic view illustrating a plurality of second supporting rods and third supporting rods of the anti-bedsore bed are lifted in the present invention.
Figure 8:
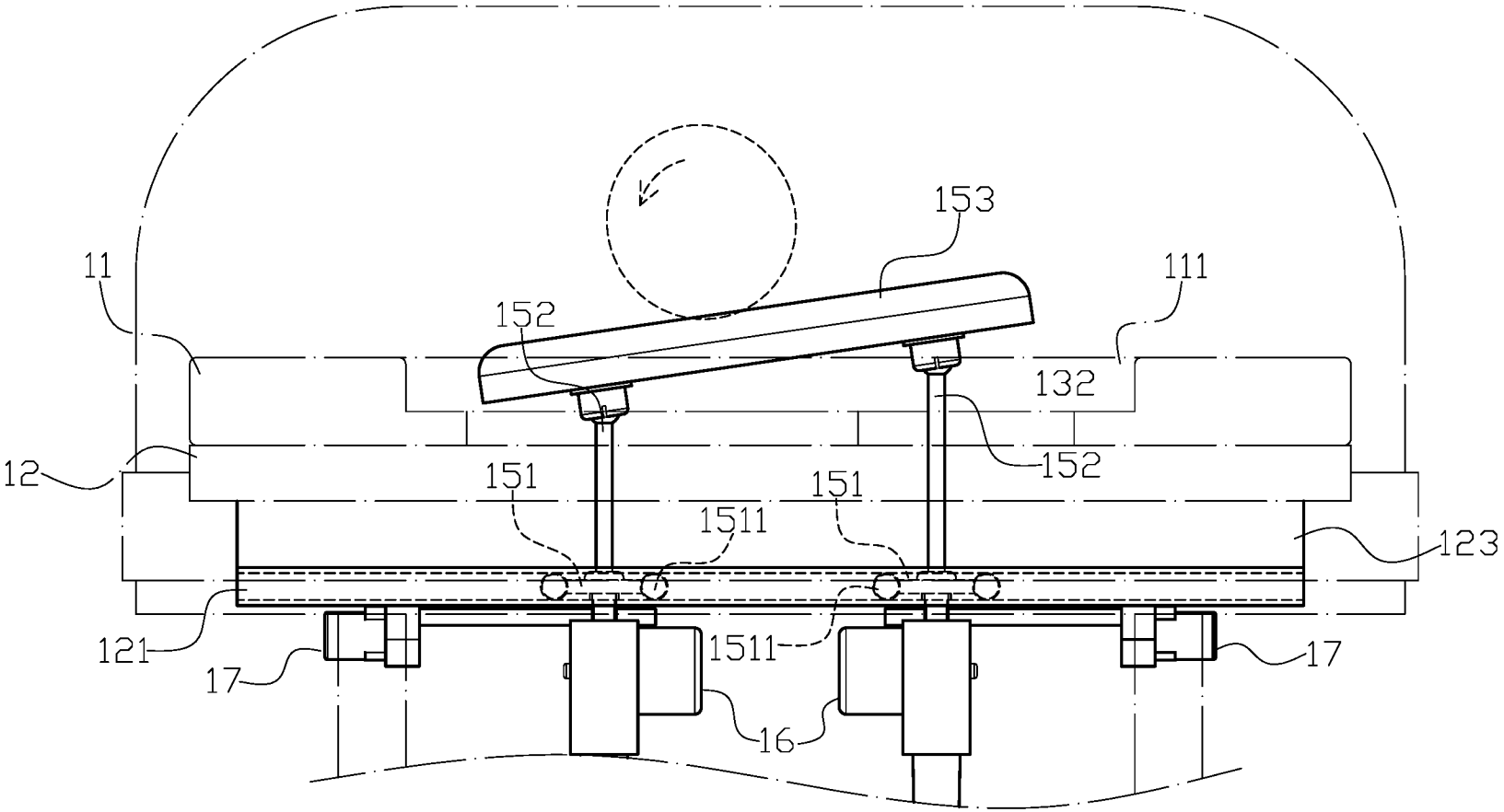
FIG. 8 is a schematic view illustrating a head rest of the anti-bedsore bed naturally leans to one side in the present invention.
Figure 9:
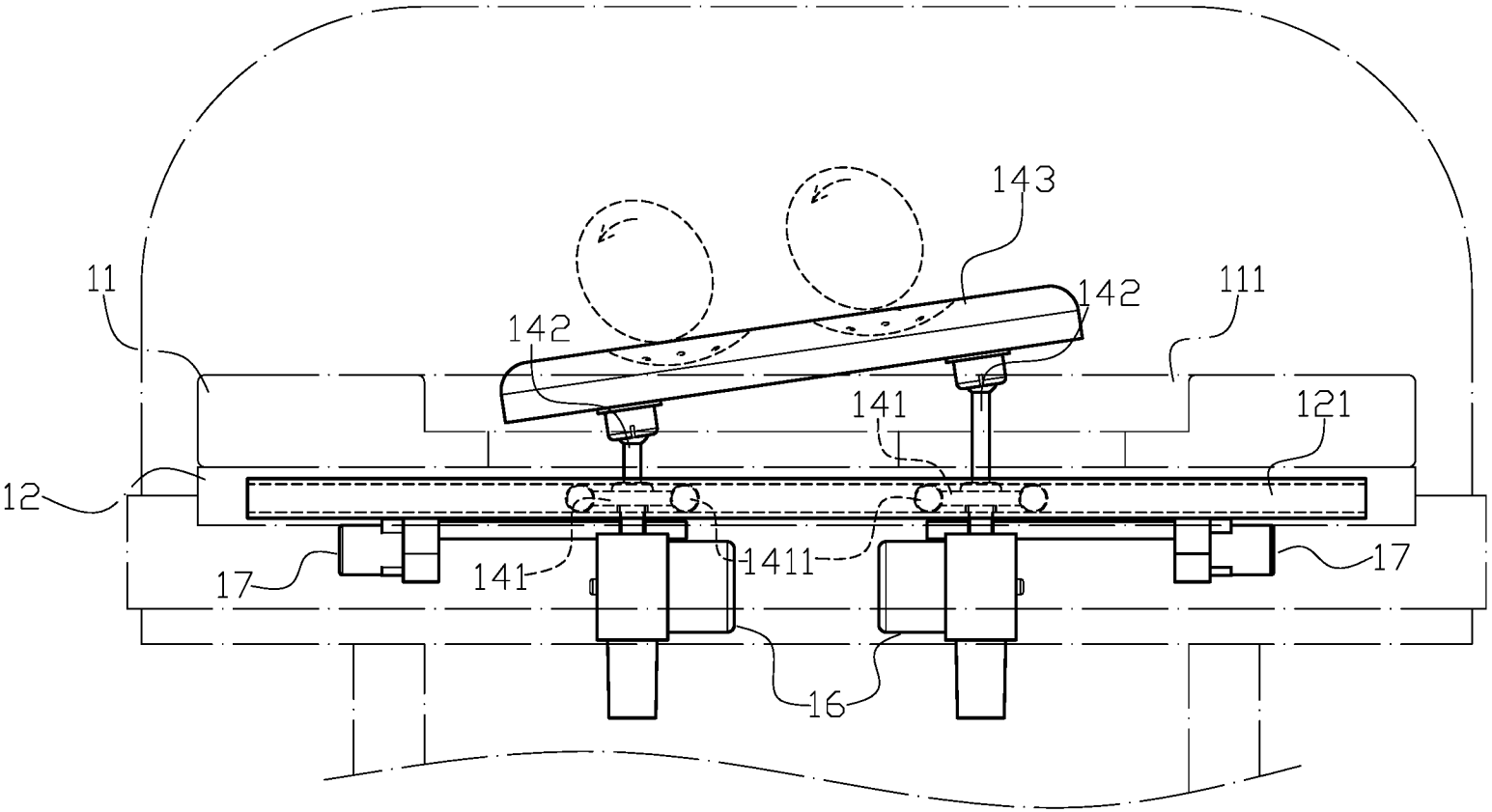
FIG. 9 is a schematic view illustrating a foot rest of the anti-bedsore bed naturally leans to one side in the present invention.
Figure 10:
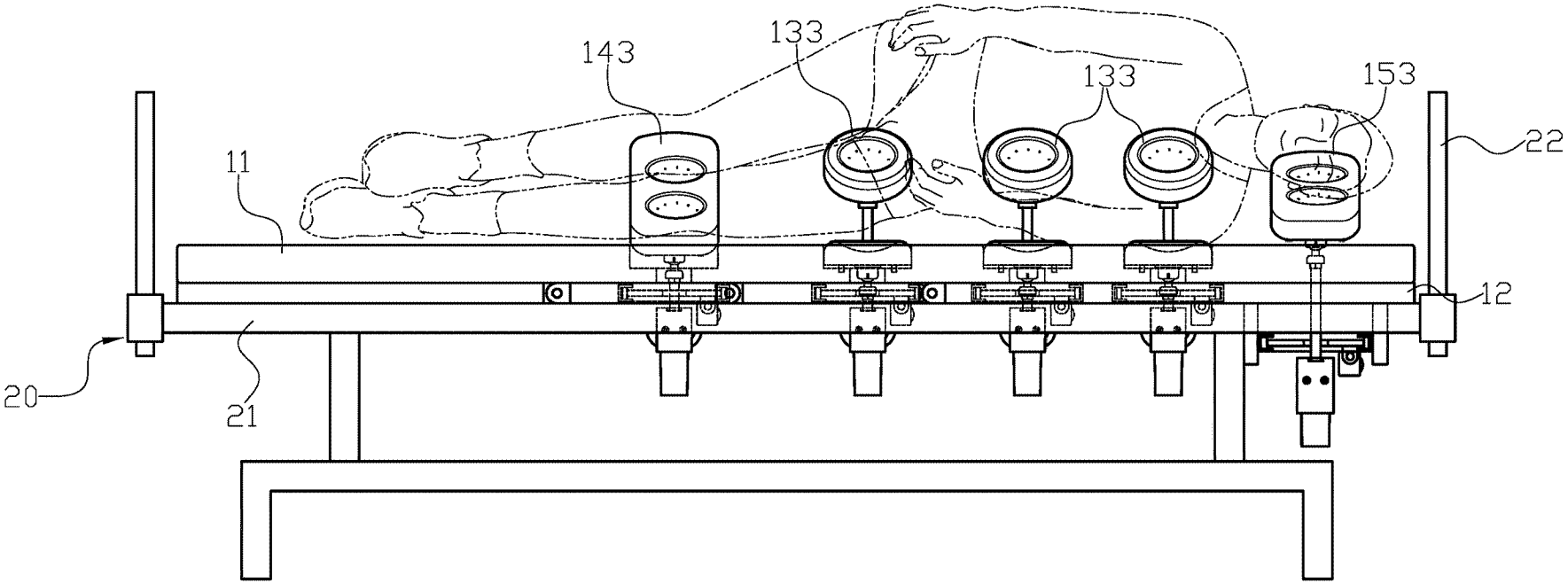
FIG. 10 is a schematic view illustrating the foot rest, the head rest, and a plurality of abutting units drive a patient to lean to one side in the present invention.

In addition, when a patient lies the bed unit (10) on his/her back, the head rest (153) and the foot rest (143) are configured to respectively be uplifted by the third supporting rods (152) and the second supporting rods (142) so as to drive the patient's head and knees up properly (as shown in FIG. 7). Thereafter, since the head rest (153) is pivotally connected to the third supporting rods (152) while the foot rest (143) is pivotally connected to the second supporting rods (142), the second supporting rods (142) or the third supporting rods (152) are configured to be stretched out in different lengths so as to enable the foot rest (143) or the head rest (153) to naturally lean to one side (as shown in FIGS. 8 and 9). As a result, the patient is easily turned by a caregiver, thereby completing actions such as cleaning body, changing clothes, changing lying positions (as shown in FIG. 10), and the foot rest (143) and the head rest (153) are adapted to uplift a patient's feet and head to temporarily detach from the first mattress (11), thereby achieving the anti-bedsore effect.

Figure 11:
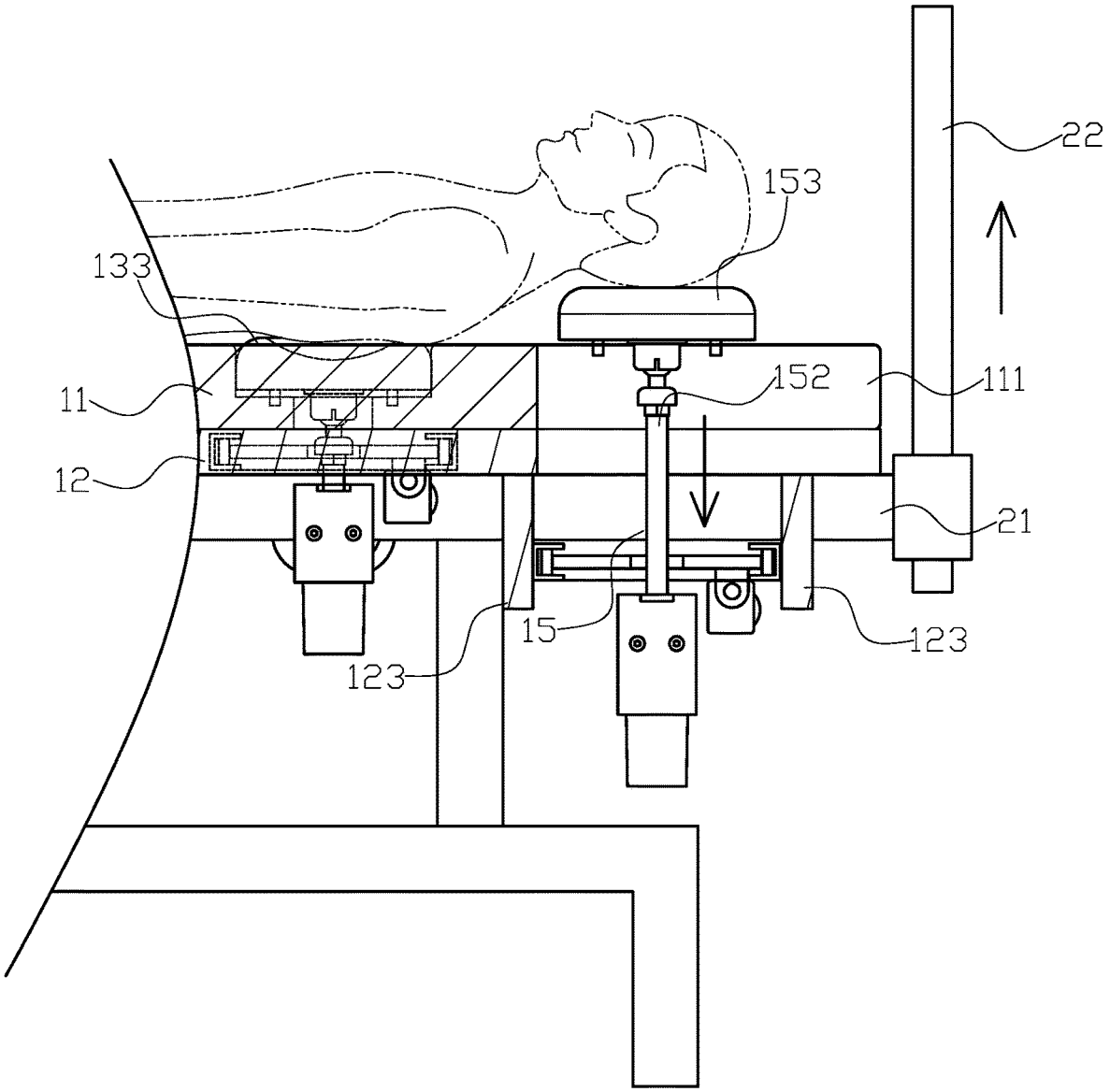
FIG. 11 is a diagram showing a patient is ready to have hair washing.
Figure 12:
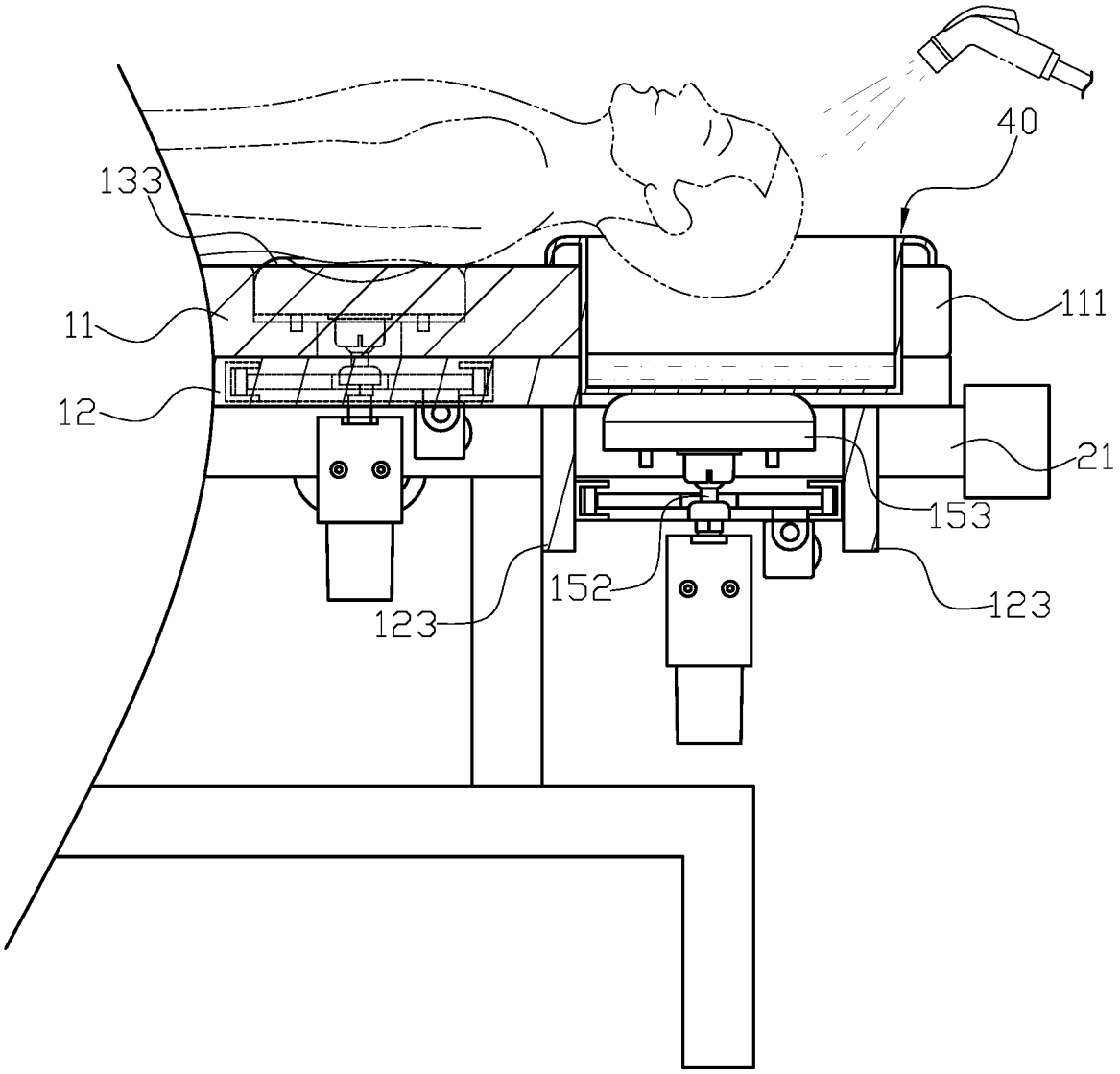
FIG. 12 is a diagram showing a patient directly have hair washing on the anti-bedsore bed of the present invention.

Furthermore, the third supporting unit (15) is installed on the bottom portion (12) through the connecting member (123) and protrudes from a lower portion of the bottom portion (12) so as to increase the moving distance of the head rest (153). When the third supporting rods (152) are completely retracted or retracted enormously and the headboard (22) of the first bed body (20) is pulled in a lateral direction (as shown in FIG. 11), a space formed above the head rest (153) is adapted to accommodate a water collector (40). Thus, the patient can directly have hair washing without leaving the first bed body (20) (as shown in FIG. 12), which prevents the patient from the risk of unnecessary harms from frequently moved.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An anti-bedsore bed comprising a bed unit, a first bed body, and a second bed body, wherein the bed unit has a first mattress, and a bottom portion is coupled on a bottom surface thereof, and the bottom portion comprises six first supporting units evenly arranged into three sets at positions corresponding to a user's upper back, middle portion of back and lower back, and each of the first supporting units has a first sliding block moveably mounted on the bottom portion; each of the first sliding blocks has a first supporting rod, and an abutting unit is pivotally connected to an upper end of the first supporting rod; each of first power units secured on a bottom surface of the first sliding block is engaged with the first supporting rod while each of second power units secured on the bottom portion is engaged with the first sliding block such that the first supporting rod is configured to be driven by the first power unit to move upwardly or downwardly, and the second power unit is adapted to drive the two adjacent first sliding blocks to move in lateral directions; the positions of the first supporting units are adjustable according to a position of the back portion of a user, and the bottom portion comprises a second supporting unit and a third supporting unit respectively located at positions corresponding to a user's knee and head, and the second supporting unit has two second sliding blocks moveably mounted on the bottom portion while the third supporting unit comprises two third sliding blocks connected to a lower portion of the bottom portion; each of the second sliding blocks has a second supporting rod while each of the third sliding blocks comprises a third supporting rod, and a top portion of the two second supporting rods is pivotally connected to a foot rest while a top portion of the two third supporting rods is pivotally connected to a head rest; the first power units secured on a bottom surface of the second sliding blocks are respectively connected to the second supporting rods while the first power units secured on a bottom surface of the third sliding blocks are respectively connected to the third supporting rods; the second power units secured on the bottom portion are respectively connected to the second sliding blocks and the third sliding blocks; the second supporting rods and the third supporting rods are configured to be driven by the first power units to move upwardly or downwardly, and the two second sliding blocks or the two third sliding blocks are adapted to be driven by the second power units to move in lateral directions synchronously; the supporting angles and directions of the second sliding blocks and the third sliding blocks are adjustable according to a lying position of a user; the first mattress comprises a plurality of through holes located at positions corresponding to the first supporting units, the second supporting unit and the third supporting unit such that the abutting units, the foot rest, the head rest are respectively accommodated in the through holes before the first supporting rods, the second supporting rods, and the third supporting rods are moved upwardly or respectively protrude out of the through holes when the first supporting rods, the second supporting rods, and the third supporting rods are lifted;

wherein the first bed body is coupled with the second bed body side by side for use, and the first bed body has a bed stead which is configured to support the bottom portion of the bed unit; and wherein the second bed body comprises a first frame, a second frame and a third frame, which are pivotally connected in sequence; a second bed mattress is positioned on an upper surface of the first frame, the second frame and the third frame, and a plurality of sliding wheels are installed at a lower portion of the second frame to enable the second bed body to be movable; each of the first frame and the third frame has at least two bed legs pivotally connected at a lower portion thereof, and the bed legs are configured to perform between an unfolded position standing on the floor and a folded position received in the first frame or the third frame; the third frame and the first frame are configured to be respectively folded up and down relative to the second frame, and after securing pivots between the first frame and the second frame and between the second frame and the third frame, the second bed body is configured to be used as a wheelchair, wherein the head rest is pivotally connected to the third supporting rods while the foot rest is pivotally connected to the second supporting rods, and the second supporting rods or the third supporting rods are configured to be stretched out in different lengths so as to enable the foot rest or the head rest to naturally lean to one side, wherein the bottom portion has a second opening located at a position corresponding to the third supporting unit, and a lower portion of the second opening is connected and secured by a connecting member which extends toward two lateral sides of the second opening, and the third supporting unit is installed on the bottom portion through the connecting member and protrudes from a lower portion of the bottom portion to increase a moving distance of the head rest.

2. The anti-bedsore bed of claim 1, wherein the first bed body is a medical bed of hospital, and said bed unit is capable of being installed on the bed stead of the first bed body by a user.

3. The anti-bedsore bed of claim 1, wherein the bottom portion comprises a plurality of first openings located at positions corresponding to the first supporting units and the second supporting unit, and each of the first openings has two sliding grooves formed on an inner surface thereof; the sliding grooves are configured to couple with two first wheel bodies of the first sliding block and two second wheel bodies of the second sliding block; the second power units respectively connected to the first supporting units and the second supporting unit are adapted to be secured on a supporting bar which is located between the two adjacent sliding grooves.

4. The anti-bedsore bed of claim 1, wherein the connecting member comprises two sliding grooves which are configured to couple with third wheel bodies formed at two sides of the third supporting unit, and the second power unit connected to the third supporting unit is secured on a supporting bar which is located between the two adjacent sliding grooves.

5. The anti-bedsore bed of claim 1, wherein each of the first power units is a first motor having a gear wheel rotatably mounted on a spindle thereof, and the gear wheel is configured to be engaged with the first supporting rods, the second supporting rods, and the third supporting rods which are formed in gear racks such that the first motor is adapted to drive the first supporting rods, the second supporting rods, and the third supporting rods to move upwardly or downwardly; the first motor has a function of vibration to massage a user through the abutting unit, the foot rest, and head rest when the first supporting rods, the second supporting rods, and the third supporting rods are moved.

6. The anti-bedsore bed of claim 1, wherein each of the second power units comprises a second motor and a screw rod collaborated with each other, and each of screw nuts respectively secured on the bottom surfaces of the first sliding blocks, the second sliding blocks, and the third sliding blocks is moveably engaged with the screw rod such that the second motor is adapted to drive the first sliding blocks, the second sliding blocks, and the third sliding blocks to have movement in lateral directions.

7. The anti-bedsore bed of claim 1, wherein each of the abutting unit, the foot rest, and the head rest is a cushion having a concaved top surface.

8. The anti-bedsore bed of claim 1, wherein each of the abutting unit, the foot rest, and the head rest is an air bag which is configured to be inflated and deflated.

9. The anti-bedsore bed of claim 1, wherein each of the abutting unit, the foot rest, and the head rest is connected to an air pump through a hose.

10. The anti-bedsore bed of claim 1, wherein the first supporting units, the second supporting unit, and the third supporting unit are electrically connected to a control unit which is provided to control the first supporting units, the second supporting unit, and the third supporting unit to perform different actuation patterns and control the time intervals of the actuations of the first supporting units, the second supporting unit, and the third supporting unit.

* * * * *